US010883787B2

(12) United States Patent
Palu et al.

(10) Patent No.: US 10,883,787 B2
(45) Date of Patent: Jan. 5, 2021

(54) LOCKING MECHANISM FOR SUPPRESSOR MOUNT

(71) Applicant: Thunder Beast Arms Corporation, Cheyenne, WY (US)

(72) Inventors: Kurtis Allen Palu, Cheyenne, WY (US); Sutherland Detweiler, Cheyenne, WY (US)

(73) Assignee: Thunder Beast Aims Corporation, Cheyenne, WY (US)

( * ) Notice: Subject to any disclaimer, the term of this patent is extended or adjusted under 35 U.S.C. 154(b) by 0 days.

(21) Appl. No.: 16/601,374

(22) Filed: Oct. 14, 2019

(65) Prior Publication Data

US 2020/0056855 A1 Feb. 20, 2020

Related U.S. Application Data

(63) Continuation-in-part of application No. 15/707,874, filed on Sep. 18, 2017, now Pat. No. 10,502,514, which is a continuation of application No. 15/281,323, filed on Sep. 30, 2016, now Pat. No. 9,791,234.

(60) Provisional application No. 62/236,487, filed on Oct. 2, 2015.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/30; F41A 21/325; F41A 21/34; F41A 21/36; F41A 21/32; F41C 27/00
See application file for complete search history.

(56) References Cited

U.S. PATENT DOCUMENTS 4,576,083 A 3/1986 Seberger, Jr.
4,907,488 A 3/1990 Seberger
5,433,133 A 7/1995 La France
(Continued)

FOREIGN PATENT DOCUMENTS

WO WO 1997/007375 A2 2/1997

OTHER PUBLICATIONS

U.S. Appl. No. 15/281,323; NonFinal Office Action dated Feb. 17, 2017; 13 pages.

(Continued)

*Primary Examiner* — Benjamin P Lee
(74) *Attorney, Agent, or Firm* — Adsero IP

(57) ABSTRACT

A novel locking mechanism is provided for a noise suppressor mount for a firearm. The locking mechanism comprises a muzzle attachment comprising a plurality of locking positions, a collar, and a locking arm comprising a locking notch, wherein the collar rotates to move the locking notch in a circular direction into a locking position. In some cases, the locking mechanism further comprises a protection arm comprising a blocking arm, wherein, with the locking notch moved into the locking position and without a muzzle attachment being fully inserted within the collar, the protection arm is set to an engaged state in which the blocking arm has been extended toward the central portion of the collar, thereby preventing subsequent full insertion of a muzzle attachment, and wherein, with the locking notch moved into the locking position and with a muzzle attachment fully inserted, the protection arm is set to a disengaged state.

18 Claims, 17 Drawing Sheets

(56) References Cited

U.S. PATENT DOCUMENTS

| | | | |
|---|---|---|---|
| 5,596,161 | A | 1/1997 | Sommers |
| 6,308,609 | B1 | 10/2001 | Davies |
| 6,948,415 | B2 | 9/2005 | Matthews et al. |
| 7,062,874 | B1 | 6/2006 | Smith |
| 7,237,467 | B1 | 7/2007 | Melton |
| 7,308,967 | B1 | 12/2007 | Hoel |
| 7,588,122 | B2 | 9/2009 | Brittingham |
| 7,600,606 | B2 | 10/2009 | Brittingham |
| 7,610,710 | B2 | 11/2009 | Brittingham |
| 7,661,349 | B1 | 2/2010 | Brittingham |
| 7,676,976 | B2 | 3/2010 | Dueck et al. |
| 7,743,693 | B1 | 6/2010 | Brittingham |
| 7,789,009 | B1 | 9/2010 | Brittingham |
| 7,856,914 | B2 | 12/2010 | Shults et al. |
| 7,874,238 | B2 | 1/2011 | Silvers |
| 7,946,069 | B2 | 5/2011 | Dueck et al. |
| 8,091,462 | B2 | 1/2012 | Dueck et al. |
| 8,196,701 | B1 | 6/2012 | Oliver |
| 8,201,487 | B2 | 6/2012 | Dueck et al. |
| 8,209,895 | B2 | 7/2012 | Dueck et al. |
| 8,286,750 | B1 | 10/2012 | Oliver |
| 8,397,862 | B2 | 3/2013 | Shand |
| 8,459,406 | B1 | 6/2013 | Dueck |
| 8,490,535 | B1 | 7/2013 | Moore et al. |
| 8,499,676 | B1 | 8/2013 | Moore et al. |
| 8,505,680 | B2 | 8/2013 | Dueck |
| 8,516,941 | B1 | 8/2013 | Oliver |
| 8,539,708 | B2 | 9/2013 | Kenney et al. |
| 8,555,765 | B2 | 10/2013 | Graham et al. |
| 8,584,794 | B2 | 11/2013 | Dueck |
| 8,714,301 | B2 | 5/2014 | Shults |
| 8,763,510 | B2 | 7/2014 | Dueck et al. |
| 8,826,793 | B2 | 9/2014 | Oliver |
| 9,464,857 | B2 | 10/2016 | Lessard |
| 9,513,078 | B1 | 12/2016 | Fulton et al. |
| 9,791,234 | B2 | 10/2017 | Palu |
| 10,502,514 | B2 | 12/2019 | Palu |
| 2005/0115394 | A1 | 6/2005 | Matthews et al. |
| 2006/0060076 | A1 | 3/2006 | Dueck et al. |
| 2010/0313743 | A1 | 12/2010 | Dueck et al. |
| 2011/0197487 | A1 | 8/2011 | Humston |
| 2012/0103176 | A1 | 5/2012 | Latka |
| 2012/0180623 | A1 | 7/2012 | Graham, II et al. |
| 2013/0000170 | A1 | 1/2013 | Dueck et al. |
| 2013/0180150 | A1 | 7/2013 | Dueck |
| 2013/0180796 | A1 | 7/2013 | Dueck et al. |
| 2014/0237881 | A1 | 8/2014 | Mack |
| 2015/0260472 | A1 | 9/2015 | Smith |
| 2016/0209151 | A1 | 7/2016 | Smith |
| 2016/0209152 | A1 | 7/2016 | Dueck et al. |
| 2016/0209153 | A1 | 7/2016 | Dueck et al. |

OTHER PUBLICATIONS

U.S. Appl. No. 15/281,323; Notice of Allowance dated Jun. 19, 2017; 16 pages.

U.S. Appl. No. 15/707,874; NonFinal Office Action dated Aug. 8, 2019; 18 pages.

U.S. Appl. No. 15/707,874; Notice of Allowance dated Oct. 31, 2019; 14 pages.

LOCKING MECHANISM FOR SUPPRESSOR MOUNT

CROSS REFERENCE TO RELATED APPLICATIONS

This application is a continuation-in-part of U.S. patent application Ser. No. 15/707,874 (the "'874 Application"), filed Sep. 18, 2017, by Kurtis Allen Palu, entitled "Locking Mechanism for Suppressor Mount," which is a continuation of U.S. patent application Ser. No. 15/281,323 (the "'323 Application"), filed Sep. 30, 2016, by Kurtis Allen Palu, entitled "Locking Mechanism for Suppressor Mount," which claims priority to U.S. patent application Ser. No. 62/236,487 (the "'487 Application"), filed Oct. 2, 2015, by Kurtis Allen Palu, entitled "Suppressor Mount," the entire disclosure of each of which is incorporated herein by reference in its entirety for all purposes.

The respective disclosures of these applications/patents (which this document refers to collectively as the "Related Applications") are incorporated herein by reference in their entirety for all purposes.

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to a locking mechanism for a noise suppressor mount for a firearm that prevents the suppressor from becoming loose and misaligned during use of the firearm.

BACKGROUND

A noise suppressor is a device used with a firearm to reduce muzzle blast, which is a term commonly used to describe the loud noise created during the discharge of the firearm. A noise suppressor is often attached to a firearm by threading the suppressor either directly to the barrel of the firearm or to a muzzle attachment, such as a muzzle brake or flash suppressor. Noise suppressors that are threaded to a firearm and subjected to rapid fire use have a tendency to vibrate loose during use, which can cause the suppressor to become misaligned with the firearm. When a suppressor becomes misaligned during use of the firearm, the suppressor can sustain substantial damage and significantly decrease the accuracy of the firearm. Existing suppressor systems attempt to address this problem by adding a locking mechanism to the suppressor in order to aid in the retention of the suppressor during use of the firearm. However, existing locking mechanisms only work effectively when the locking mechanism engages discrete locking positions on the firearm. When existing locking mechanisms fail to engage such locking positions, the locking mechanism will loosen, which can greatly affect the accuracy of the firearm and suppressor.

Accordingly, there is a need for a suppressor locking mechanism that does not loosen during use of the firearm.

DETAILED DESCRIPTION

While various aspects and features of certain embodiments have been summarized above, the following detailed description illustrates a few exemplary embodiments in further detail to enable one of skill in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the described inventions may be practiced without some of these specific details. Several embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features. For ease of reference and understanding, similar features of different embodiments are labeled with the same numbers.

Unless otherwise indicated, all numbers used herein to express quantities, dimensions, and so forth should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

Figure 1:
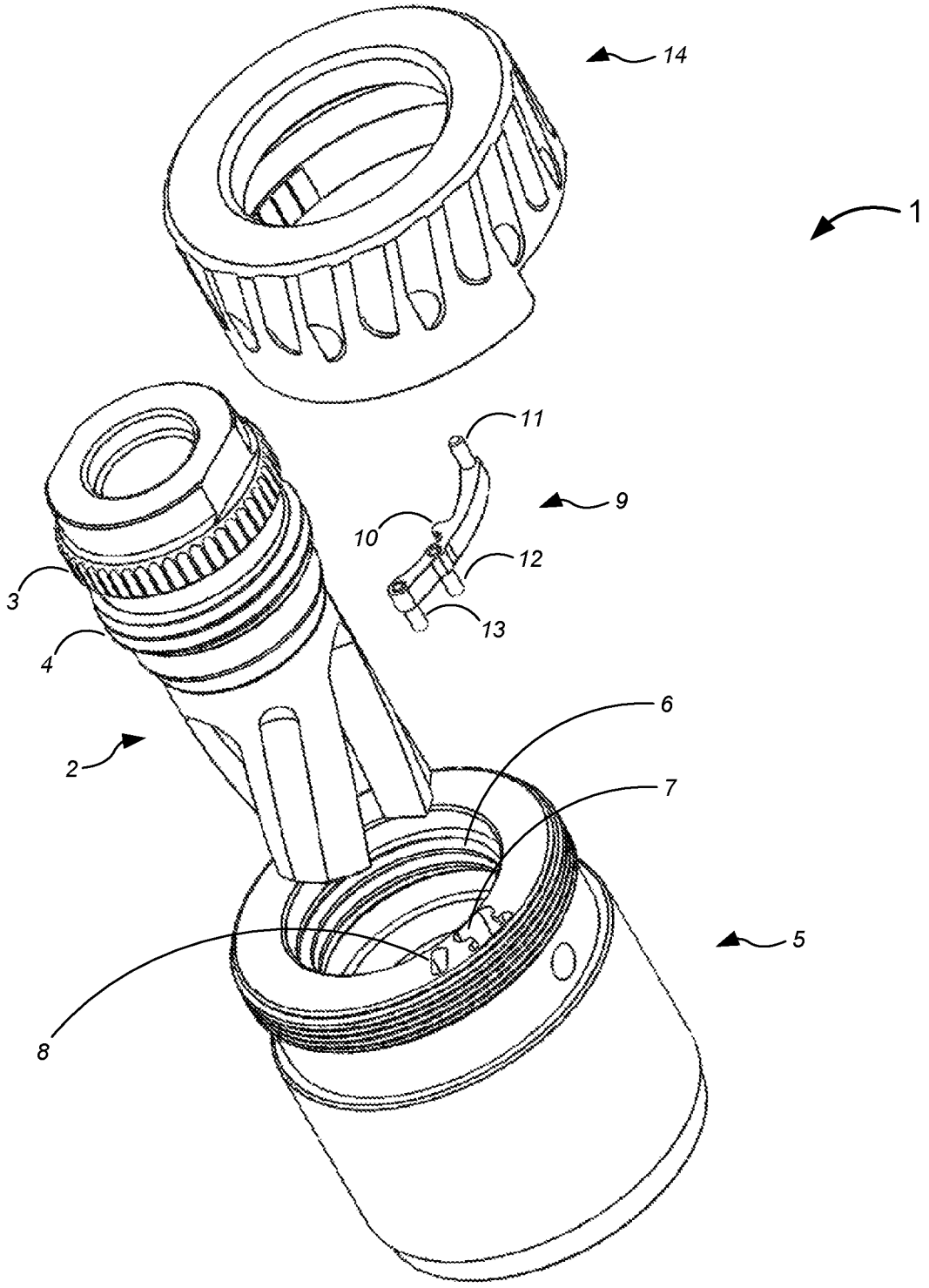
FIG. 1 shows an exploded perspective view of an embodiment of the present invention.

FIG. 1 shows an exploded perspective view of an exemplary suppressor mount locking mechanism 1 in accordance with an embodiment of the present invention. As shown, this embodiment includes a muzzle attachment 2, which is connected to the barrel of a firearm (not shown). In this exemplary embodiment, muzzle attachment 2 is an exemplary flash hider. Muzzle attachment 2 includes a plurality of locking positions 3 and a first threaded interface 4. The locking mechanism of this exemplary embodiment also includes a proximal end cap 5 with a second threaded interface 6. As used in this detailed description, the term "proximal" is used to refer to the end of the component or element closest to the barrel of the firearm and the term "distal" is used to refer to the end of the component or element farthest from the barrel of the firearm. Proximal end cap 5 also includes a first and second proximal end cap slot labeled 7 and 8, respectively. Locking mechanism 1 also includes locking arm 9, which includes locking notch 10, collar pin 11, first proximal end cap pin 12, and second proximal end cap pin 13. Finally, locking mechanism 1 includes collar 14.

Figure 2:
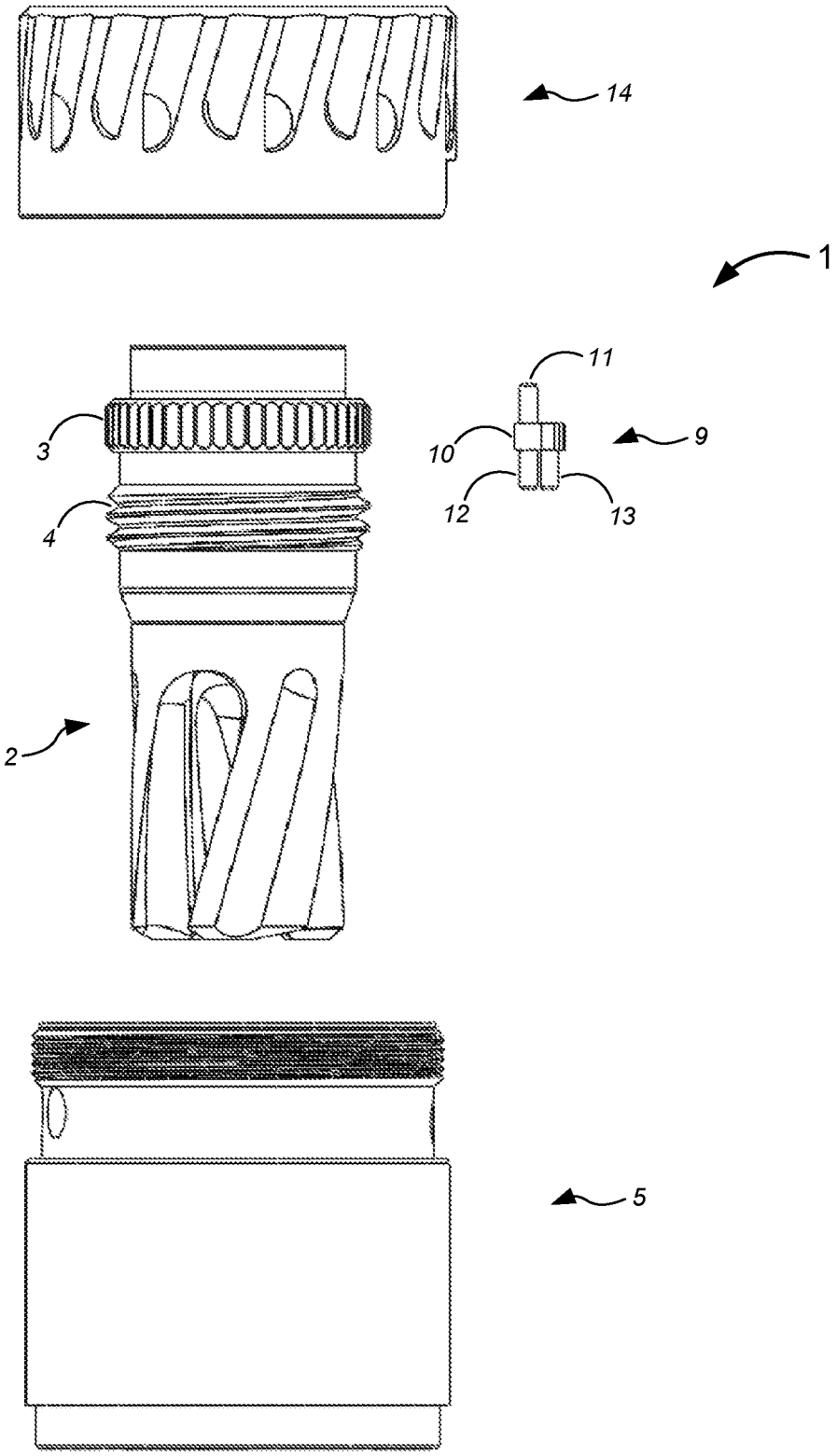
FIG. 2 shows an exploded side view of an embodiment of the present invention.

FIG. 2 shows an exploded side view of locking mechanism 1. First and second proximal end cap slots 7 and 8, respectively, are located on the top side of proximal end cap 5 and, therefore, not shown in FIG. 2.

Figure 3:
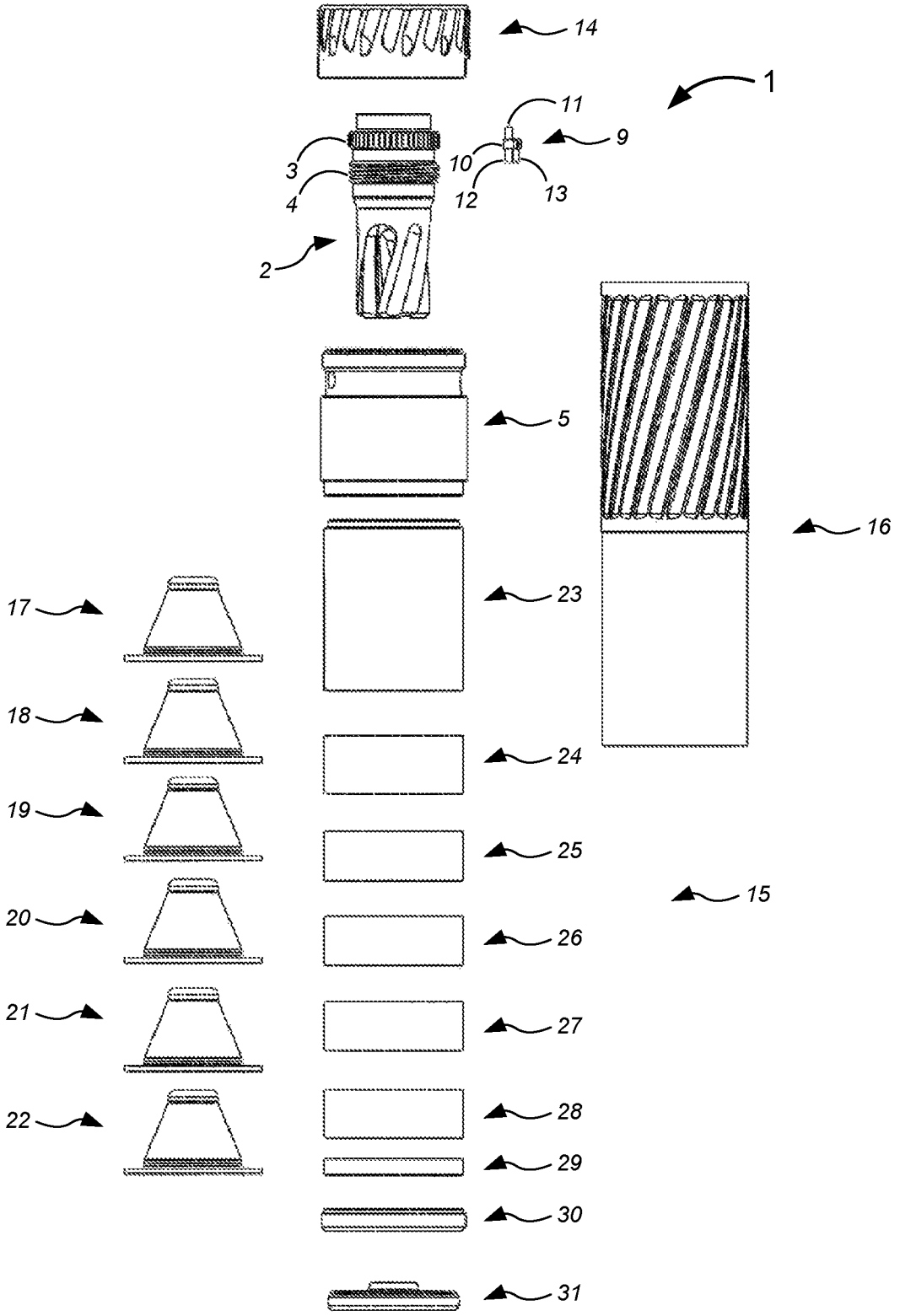
FIG. 3 shows an exploded side view of an embodiment of the present invention along with an exploded side view of an exemplary noise suppressor.

FIG. 3 shows an exploded side view of locking mechanism 1 along with an exploded side view of an exemplary noise suppressor 15. Noise suppressor 15 includes proximal end cap 5, outer tube 16, baffles 17-22, blast chamber 23, spacers 24-30, and distal end cap 31.

Noise suppressor 15 is primarily attached to muzzle attachment 2 by joining threaded interface 4 with threaded interface 6 as shown in FIG. 1. However, during rapid fire use this threaded attachment between thread 4 and thread 6 can come loose, which can cause noise suppressor 15 to become misaligned with muzzle attachment 2. As described further below, locking mechanism 1 prevents this problem by adding a secondary form of attachment.

Figure 4:
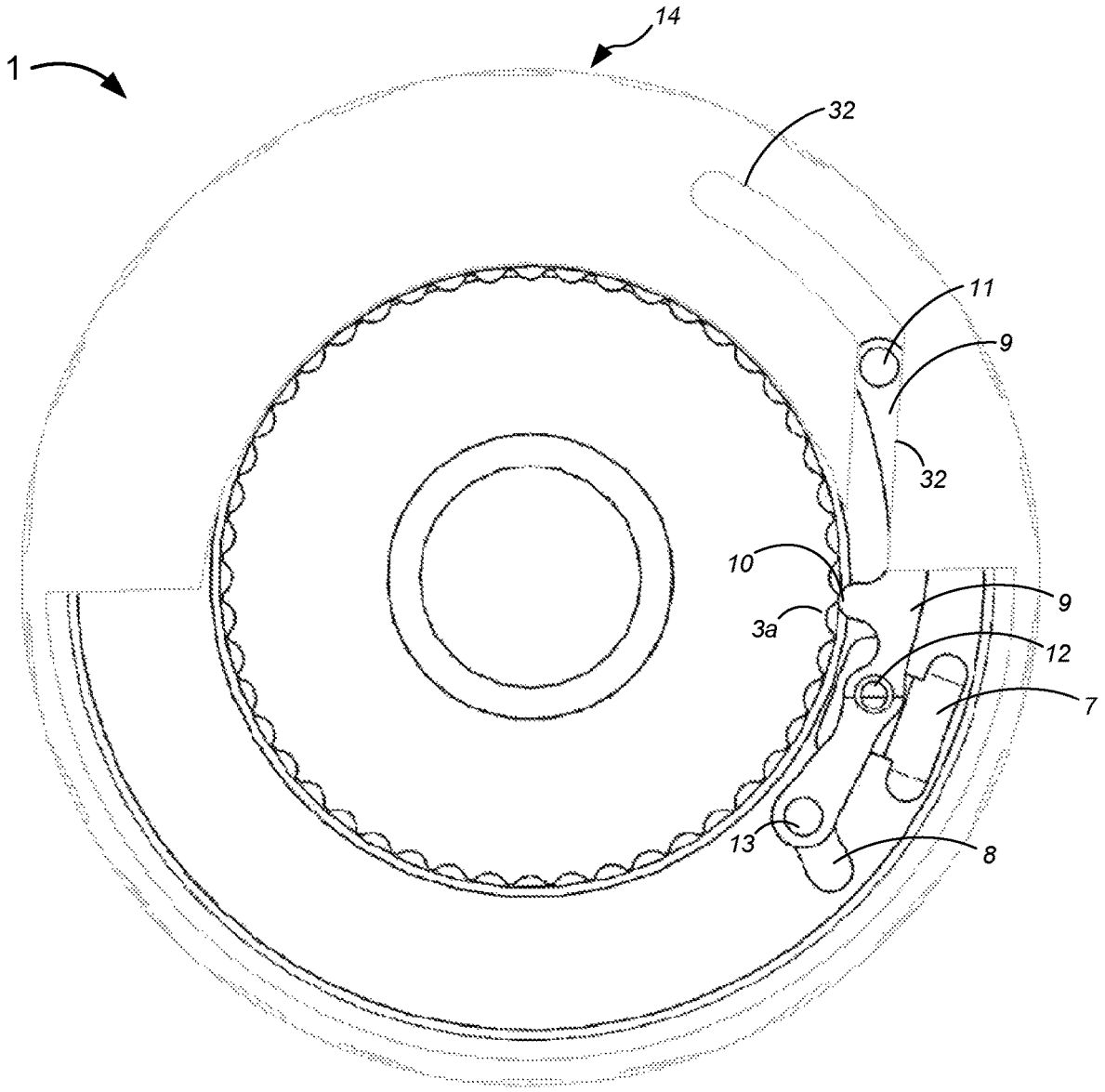
FIG. 4 shows a cross sectional view of the suppressor locking mechanism through the collar slot of an embodiment of the present invention where the locking notch is initially misaligned with the locking positions of the muzzle attachment.

FIG. 4 shows a cross sectional view of locking mechanism 1 where locking mechanism 1 has been initially attached to noise suppressor 15 by rotating collar 14 counterclockwise in order to engage locking notch 10 with locking positions 3. As used in this detailed description, the terms "counterclockwise" and "clockwise" are defined as viewed from the proximal end of collar 14 as shown in FIG. 4. However, as shown in FIG. 4, when locking notch 10 was initially engaged with locking positions 3, locking notch 10 is misaligned with locking position 3*a*. Without a further adjustment, locking notch 10 could move clockwise and loosen the attachment between noise suppressor 15 and muzzle attachment 2 or locking notch 10 could become damaged as collar 14 is further tightened counterclockwise.

To address this problem, FIG. 4 further shows additional components of locking mechanism 1, including first proximal end cap pin 12 positioned within first proximal end cap slot 7 and second proximal end cap pin 13 positioned within second proximal end cap slot 8. Locking mechanism 1 further comprises collar 14, which includes collar slot 32, and locking arm 9. As shown in FIG. 4, collar pin 11 is positioned within collar slot 32. As described further below, as collar 14 is rotated counterclockwise in this exemplary embodiment, collar slot 32 pushes down on collar pin 11, which causes locking arm 9 to push locking notch 10 clockwise into a locking position 3*a*. In this particular embodiment, locking positions 3 are defined by a series of teeth as shown in FIG. 4, however, locking positions can be defined by any number of features.

Figure 5:
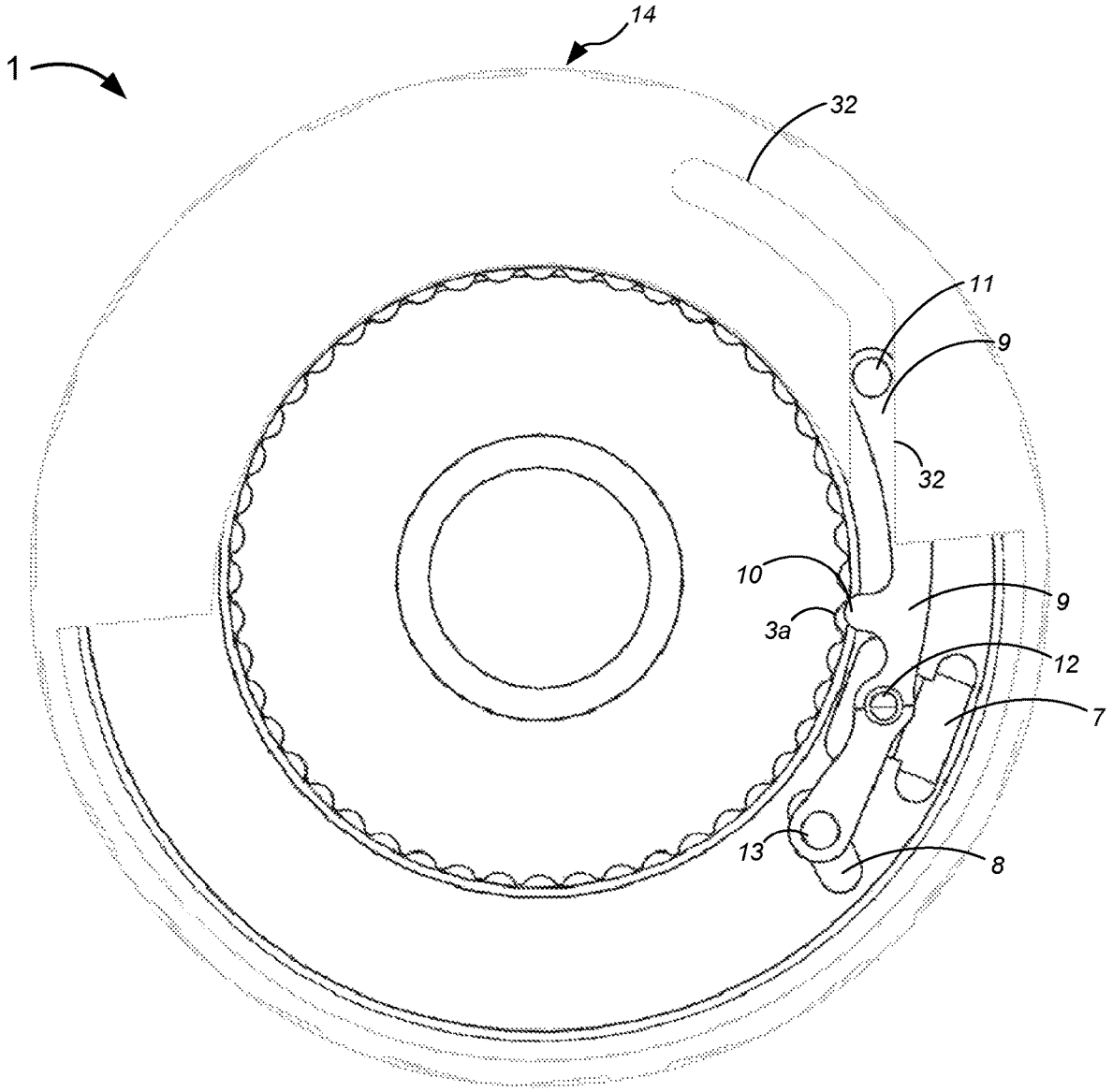
FIG. 5 shows a cross sectional view of the suppressor locking mechanism through the collar slot of an embodiment of the present invention where the locking notch is in the process of being pushed into alignment with the locking positions of the muzzle attachment.

FIG. 5 shows a cross sectional view of locking mechanism 1 where collar 14 has been partially rotated counterclockwise from its position shown in FIG. 4. As shown in FIG. 5, as collar 14 has been rotated counterclockwise, collar slot 32 has pushed down on collar pin 11 and moved collar pin 11 to a position further down collar slot 32. This movement of collar pin 11 has caused locking arm 9 to push locking notch 10 in a circular, clockwise direction closer to locking position 3*a*.

Figure 6:
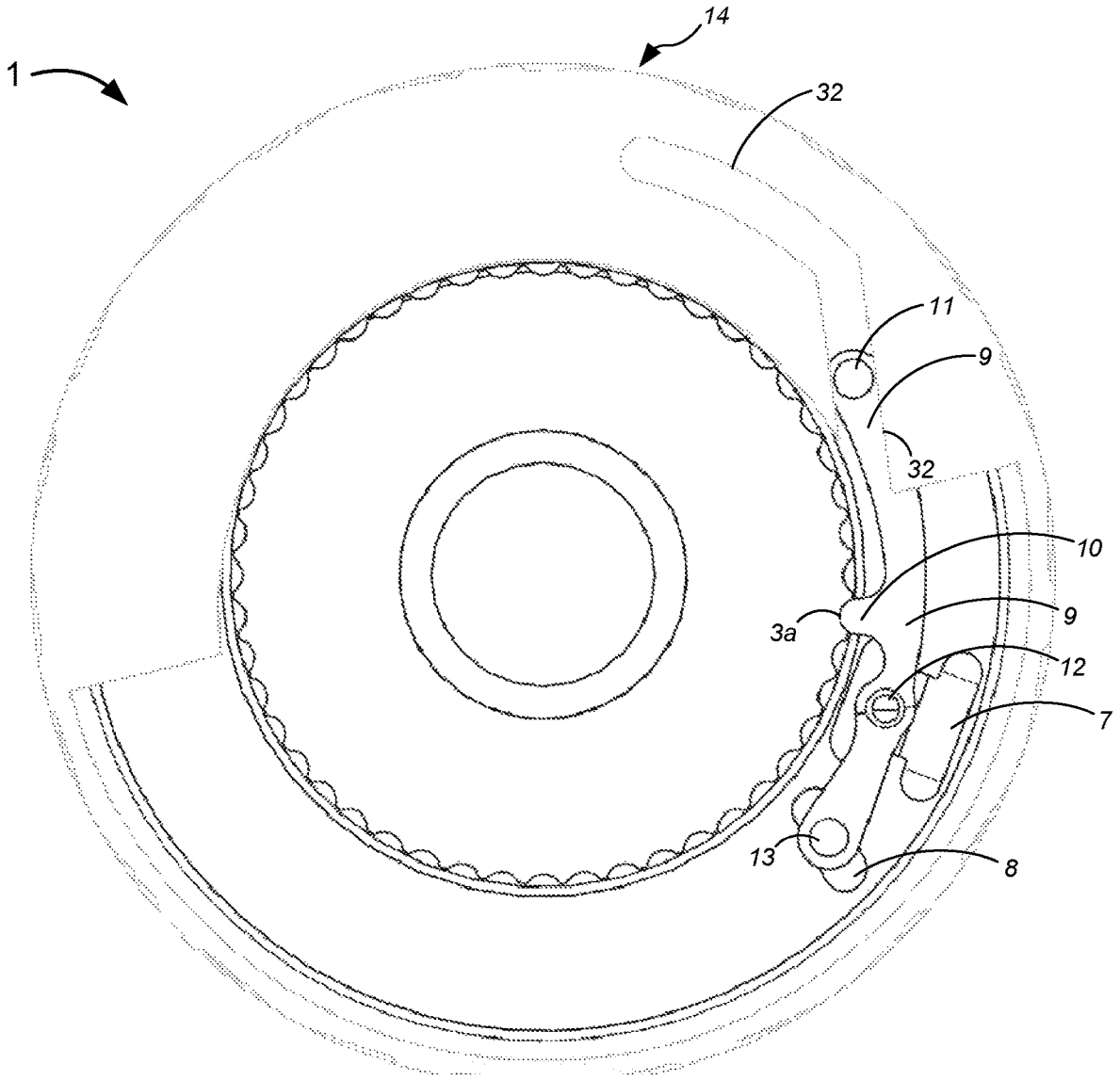
FIG. 6 shows a cross sectional view of the suppressor locking mechanism through the collar slot of an embodiment of the present invention where the locking notch has been pushed into alignment with the locking positions of the muzzle attachment.
Figure 7:
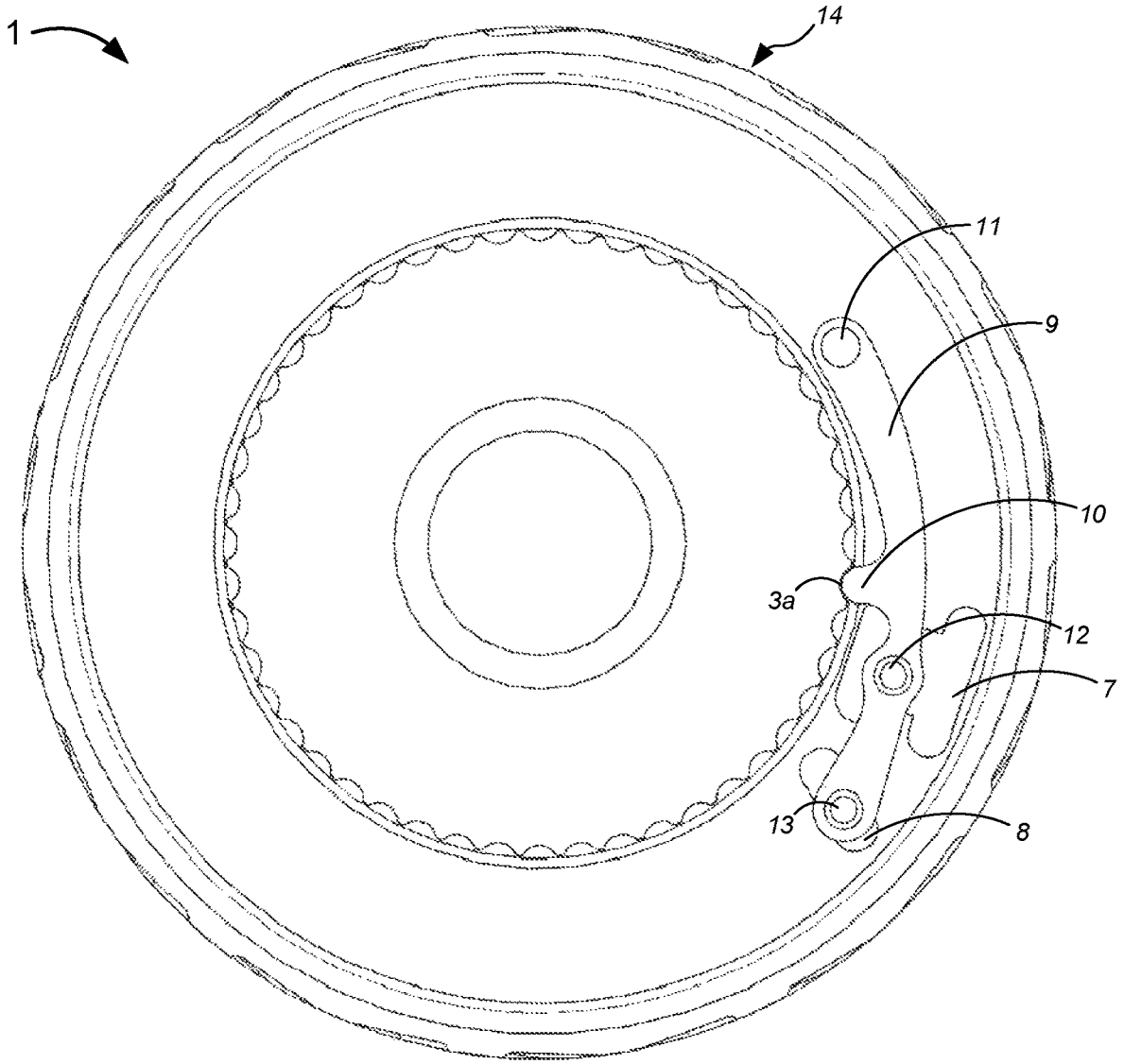
FIG. 7 shows a cross sectional view of the suppressor locking mechanism beyond the collar slot of an embodiment of the present invention where the locking notch has been pushed into alignment with the locking positions of the muzzle attachment.

FIG. 6 shows cross sectional view of locking mechanism 1 where collar 14 has been further rotated counterclockwise from its position shown in FIG. 5. As shown in FIG. 6, collar pin 11 has been further moved down collar slot 32, which has caused locking arm 9 to further push locking notch 10 into a fully locked position within locking position 3*a*. In order to show the entirety of locking arm 9, FIG. 7 shows a cross sectional view of the suppressor locking mechanism beyond the collar slot of an embodiment of the present invention where locking notch 10 is in the same fully locked position within locking position 3*a* as shown in FIG. 6. When in the position shown in FIGS. 6 and 7, noise suppressor 15 is fully locked onto muzzle attachment 2 and cannot become loose during rapid fire use.

Figure 8:
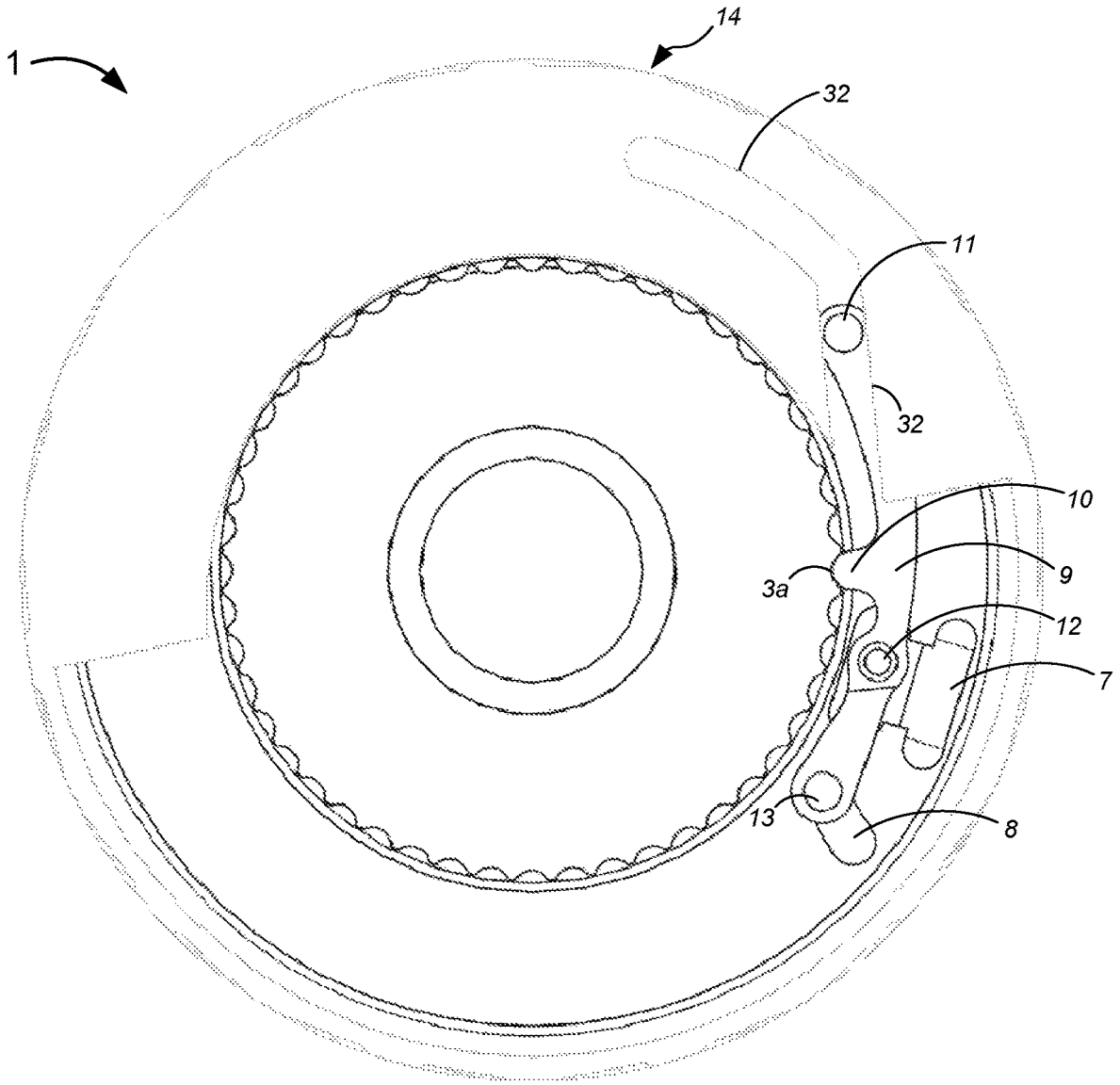
FIG. 8 shows a cross sectional view of the suppressor locking mechanism through the collar slot of an embodiment of the present invention where the locking notch is initially aligned with the locking positions of the muzzle attachment and does not need further adjustment.

Unlike the initially misaligned circumstance shown in FIG. 4, FIG. 8 shows the circumstance where locking mechanism 1 has been initially attached to noise suppressor 15 and locking notch 10 is already aligned with locking position 3*a*. In such circumstances, as shown in FIG. 8, locking arm 9 will prevent collar 14 from being moved farther counterclockwise and noise suppressor 15 will be fully locked onto muzzle attachment 2.

FIGS. 9-12 show another embodiment of the present invention. In this embodiment, collar slot 32, first and second proximal end cap slots 7 and 8, and locking arm 9 are configured slightly differently in order to allow locking arm 9 to pull (as opposed to push) locking notch 10 into a fully locked position within locking position 3*a*.

Figure 9:
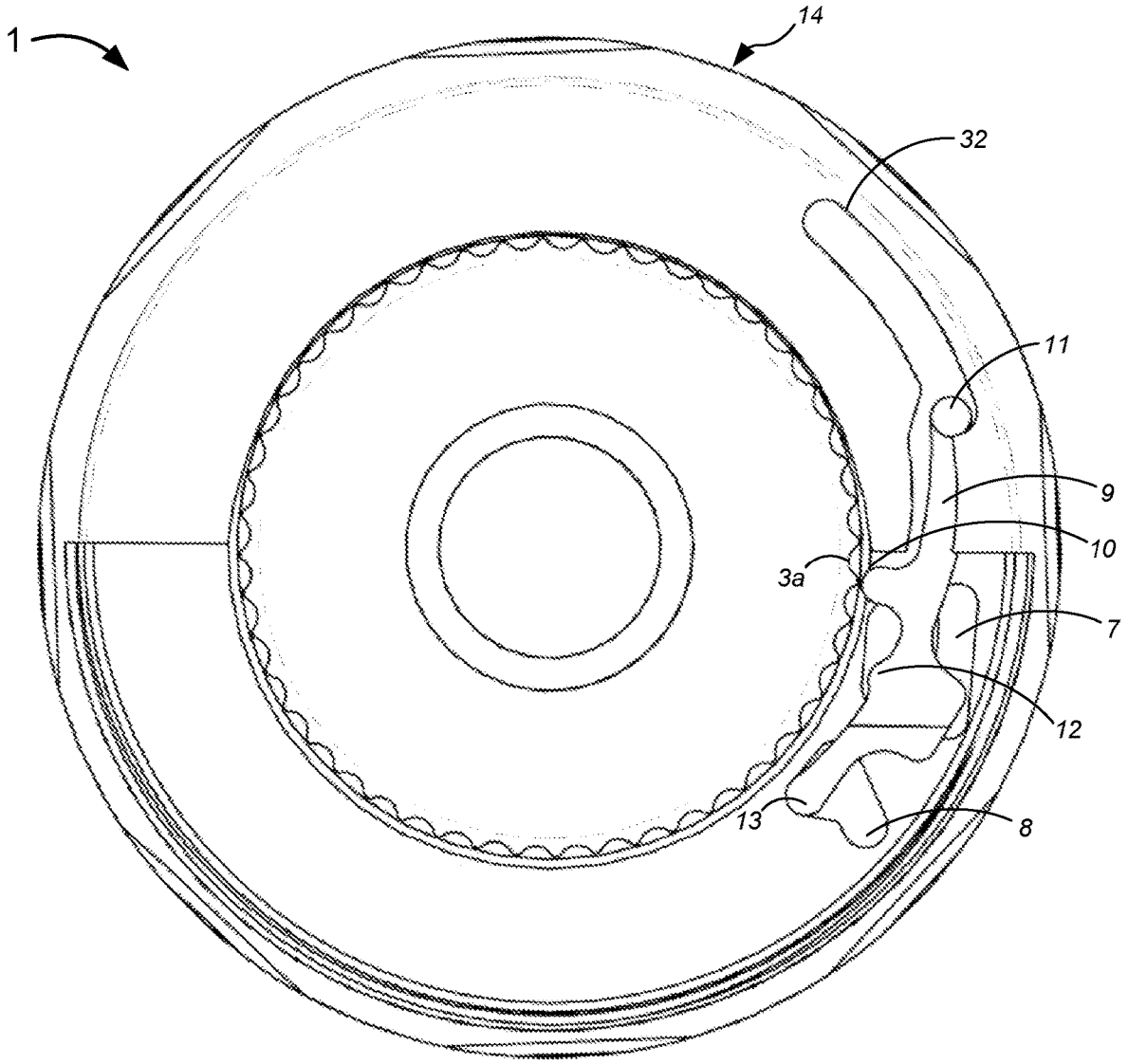
FIG. 9 shows a cross sectional view of the suppressor locking mechanism through the collar slot of another embodiment of the present invention where the locking notch is initially misaligned with the locking positions of the muzzle attachment.

FIG. 9 shows a cross sectional view of locking mechanism 1 where locking mechanism 1 has been initially attached to noise suppressor 15 and locking notch 10 is initially misaligned with locking positions 3. FIG. 9 further shows first proximal end cap pin 12 positioned within first proximal end cap slot 7 and second proximal end cap pin 13 positioned within second proximal end cap slot 8. FIG. 9 further shows collar 14, which includes collar slot 32, and locking arm 9. As shown in FIG. 9, collar pin 11 is positioned within collar slot 32. As described further below, as collar 14 is rotated counterclockwise in this exemplary embodiment, collar slot 32 pulls down on collar pin 11, which causes locking arm 9 to pull locking notch 10 in a circular, counterclockwise direction into locking position 3*a*.

Figure 10:
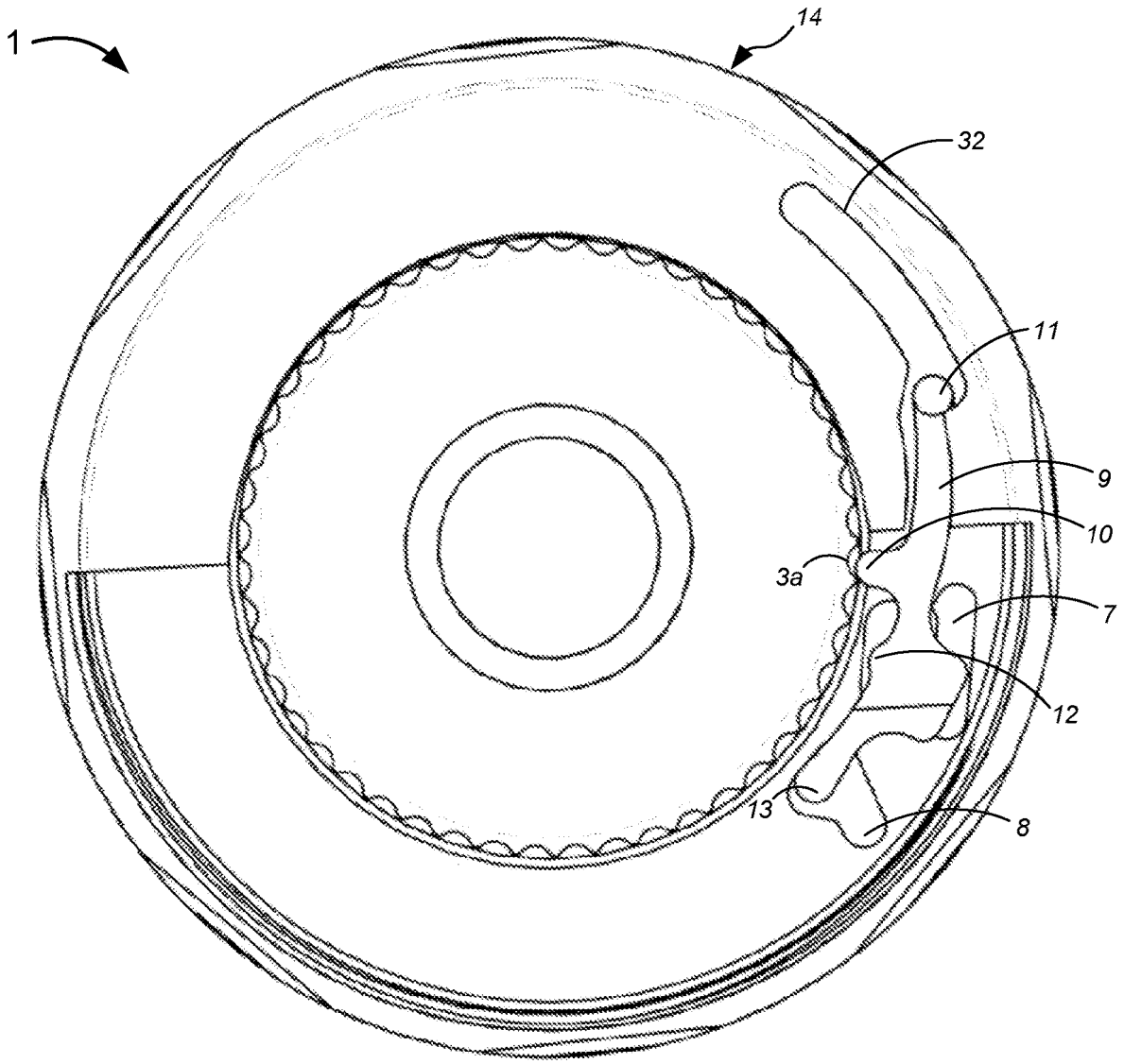
FIG. 10 shows a cross sectional view of the suppressor locking mechanism through the collar slot of another embodiment of the present invention where the locking notch is in the process of being pulled into alignment with the locking positions of the muzzle attachment.

FIG. 10 shows a cross sectional view of locking mechanism 1 where collar 14 has been partially rotated counterclockwise from its position shown in FIG. 9. As shown in FIG. 10, as collar 14 has been rotated counterclockwise, collar slot 32 has pushed down on collar pin 11 and moved collar pin 11 into a position further down collar slot 32. This movement of collar pin 11 has caused locking arm 9 to pull locking notch 10 closer to locking position 3*a*.

Figure 11:
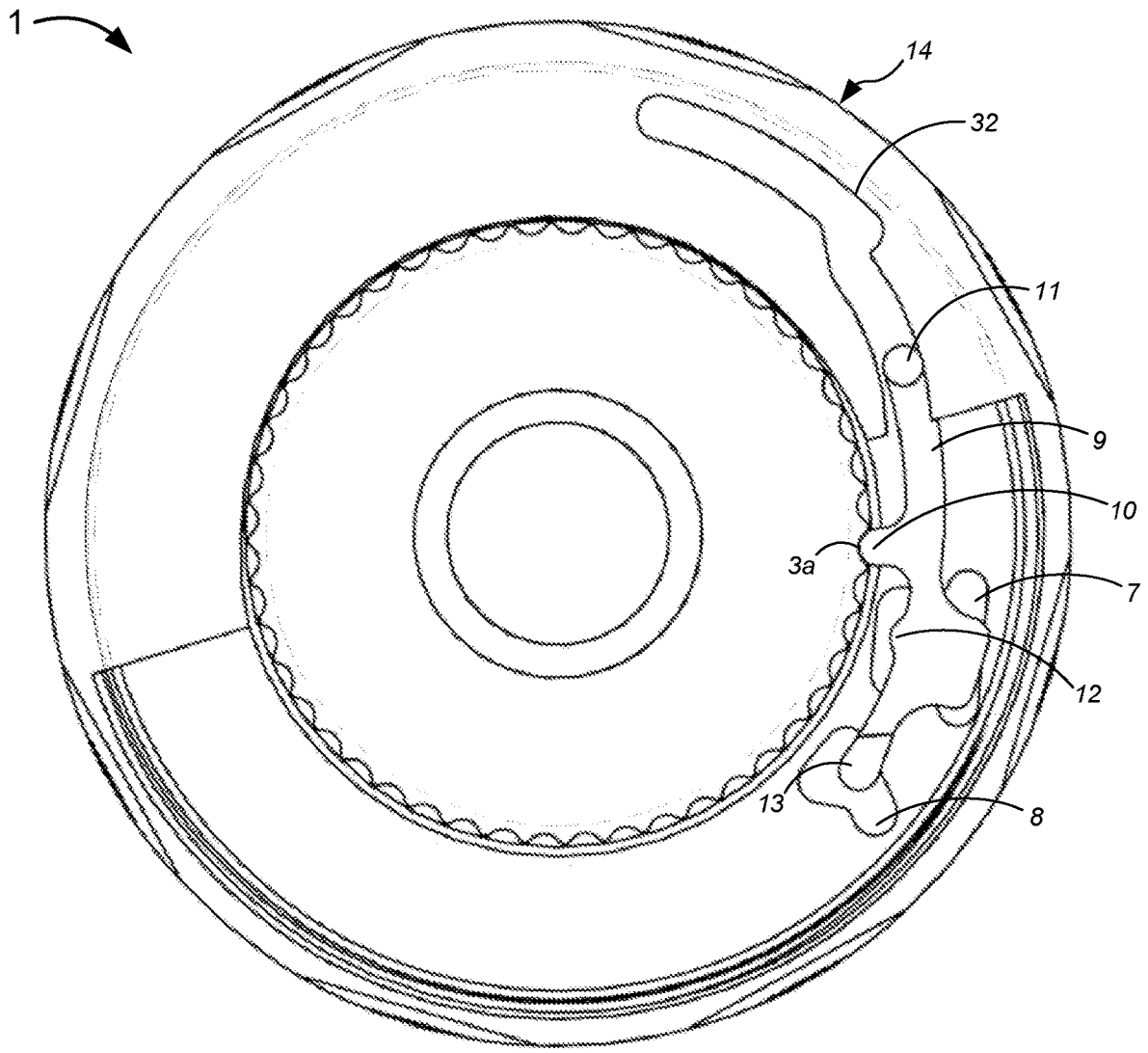
FIG. 11 shows a cross sectional view of the suppressor locking mechanism through the collar slot of another embodiment of the present invention where the locking notch has been pulled into alignment with the locking positions of the muzzle attachment.

FIG. 11 shows a cross sectional view of locking mechanism 1 where collar 14 has been further rotated counterclockwise from its position shown in FIG. 10. As shown in FIG. 11, collar pin 11 has been further moved down collar slot 32, which has caused locking arm 9 to further pull locking notch 10 into a fully locked position within locking position 3*a*. When in the position as shown in FIG. 11, noise suppressor 15 is fully locked onto muzzle attachment 2.

Figure 12:
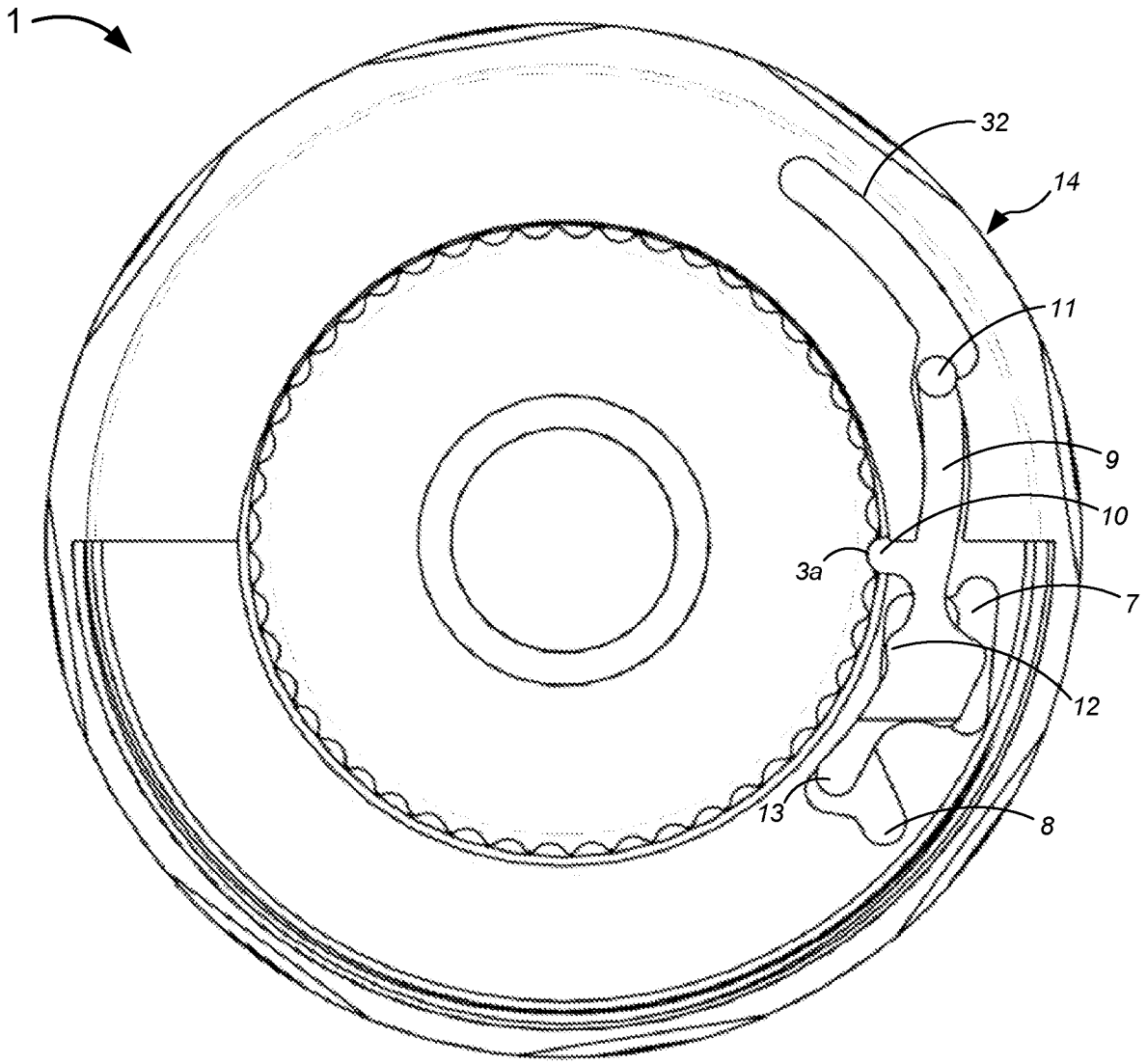
FIG. 12 shows a cross sectional view of the suppressor locking mechanism through the collar slot of another embodiment of the present invention where the locking notch is initially aligned with the locking positions of the muzzle attachment and does not need further adjustment.

Unlike the initially misaligned circumstances shown in FIG. 9, FIG. 12 shows the circumstance where locking mechanism 1 has been initially attached to noise suppressor 15 and locking notch 10 is already aligned with locking position 3*a*. In such circumstances, as shown in FIG. 12, locking arm 9 will prevent collar 14 from being moved farther counterclockwise and noise suppressor 15 will be fully locked onto muzzle attachment 2.

Figure 13:
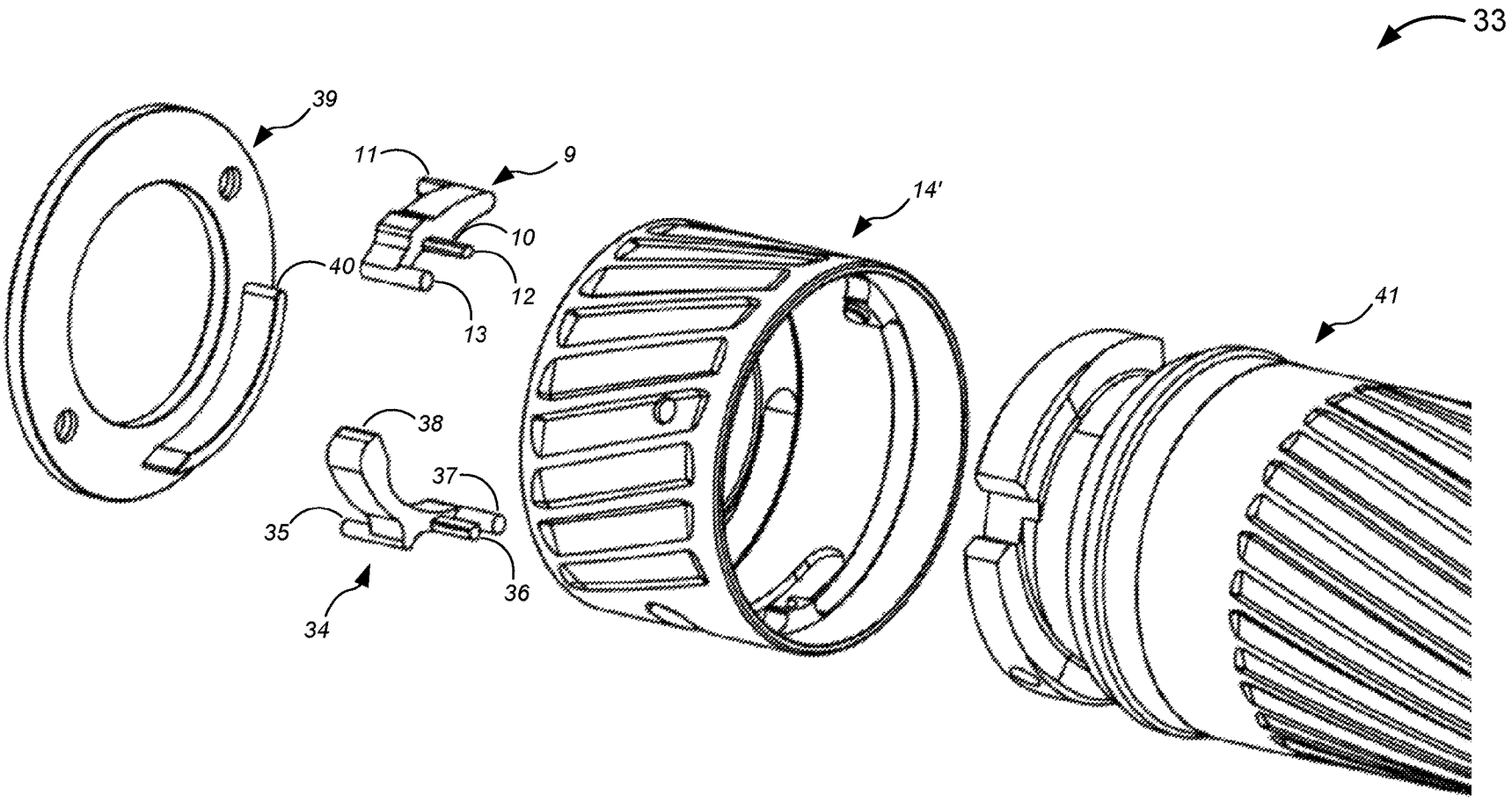
FIG. 13 shows an exploded perspective view of another embodiment of the present invention.

FIG. 13 shows an exploded perspective view of an exemplary suppressor mount locking mechanism 33 in accordance with an embodiment of the present invention. As shown, this embodiment includes locking arm 9 (similar to locking arm 9 in FIGS. 1-12), which includes locking notch 10, collar pin 11, first proximal end cap pin 12, and second proximal end cap pin 13. Locking mechanism 33 includes collar 14' and a protection arm 34, which includes collar pin 35, third proximal end cap pin 36, fourth proximal end cap pin 37, and blocking arm 38. This embodiment further includes collar cap 39, which includes cap ramp 40. This embodiment further includes suppressor 41.

Figure 14:
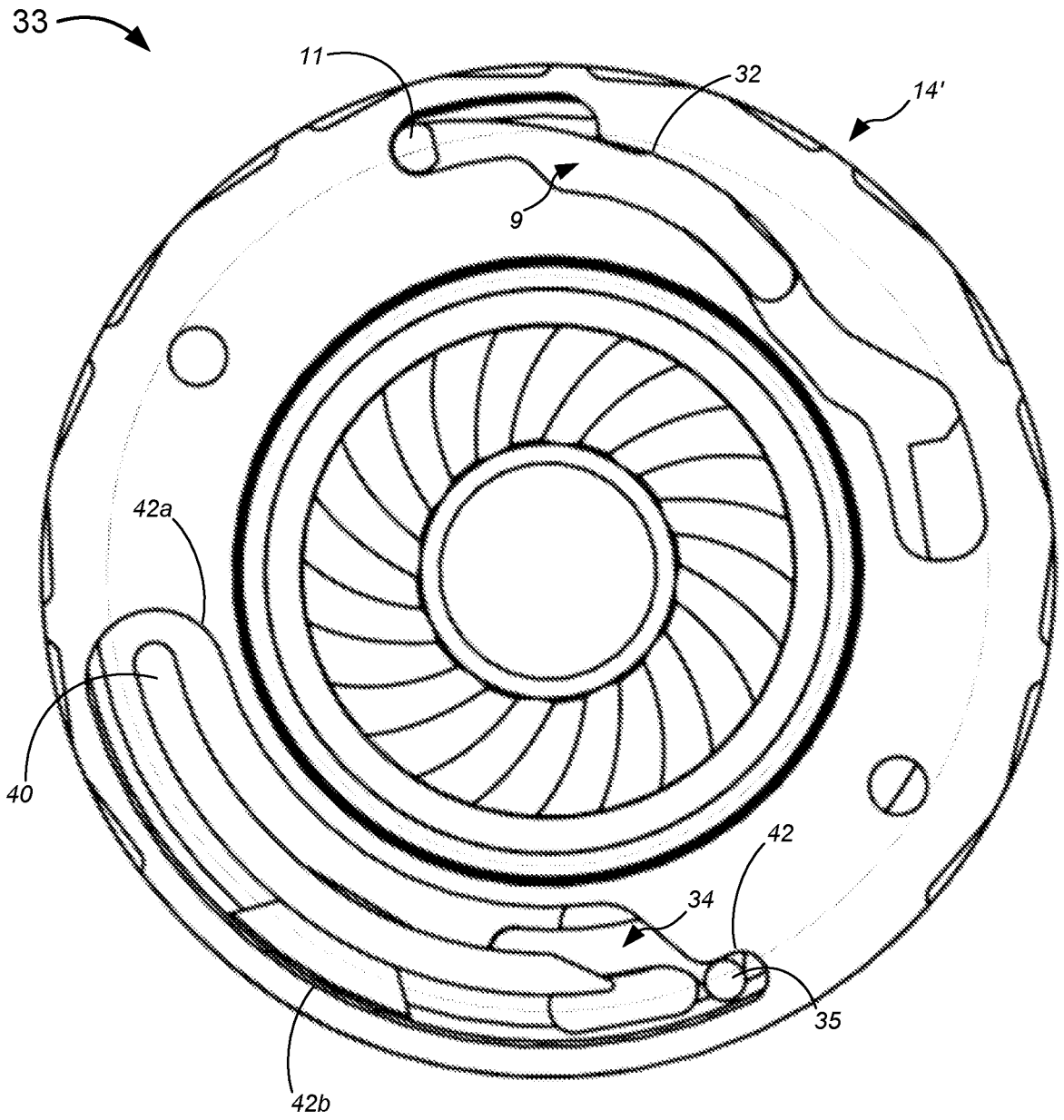
FIG. 14 shows a cross sectional view of the suppressor locking mechanism through the collar slot of an embodiment of the present invention where the locking arm is in the unlocked state without the muzzle brake or the muzzle attachment being inserted into the suppressor.

FIG. 14 shows a cross sectional view of suppressor locking mechanism 33 where the locking arm 9 is in the unlocked state without a muzzle brake or a muzzle attachment (e.g., muzzle attachment 2 of FIGS. 1-12, or the like) being inserted into the suppressor 41. In particular, as shown in FIG. 14, the locking arm 9 has been shifted within the collar 14' such that the collar pin 11 of the locking arm 9 is moved or positioned within the collar slot 32 (with the collar 14' rotated clockwise in this exemplary embodiment) until the collar pin 11 is positioned at an end portion of the collar slot 32. With reference to FIG. 14, as the locking arm 9 is rotated into the unlocked state (i.e., when the collar 14' is rotated clockwise in this exemplary embodiment), protection arm 34 is shifted within the collar 14' such that the collar pin 35 of the protection arm 34 is moved or positioned within the collar slot 42, which is divided by cap ramp 40 into first collar slot 42*a* and second collar slot 42*b*, until the collar pin 35 is positioned at an end portion of the collar slot 42.

Figure 15:
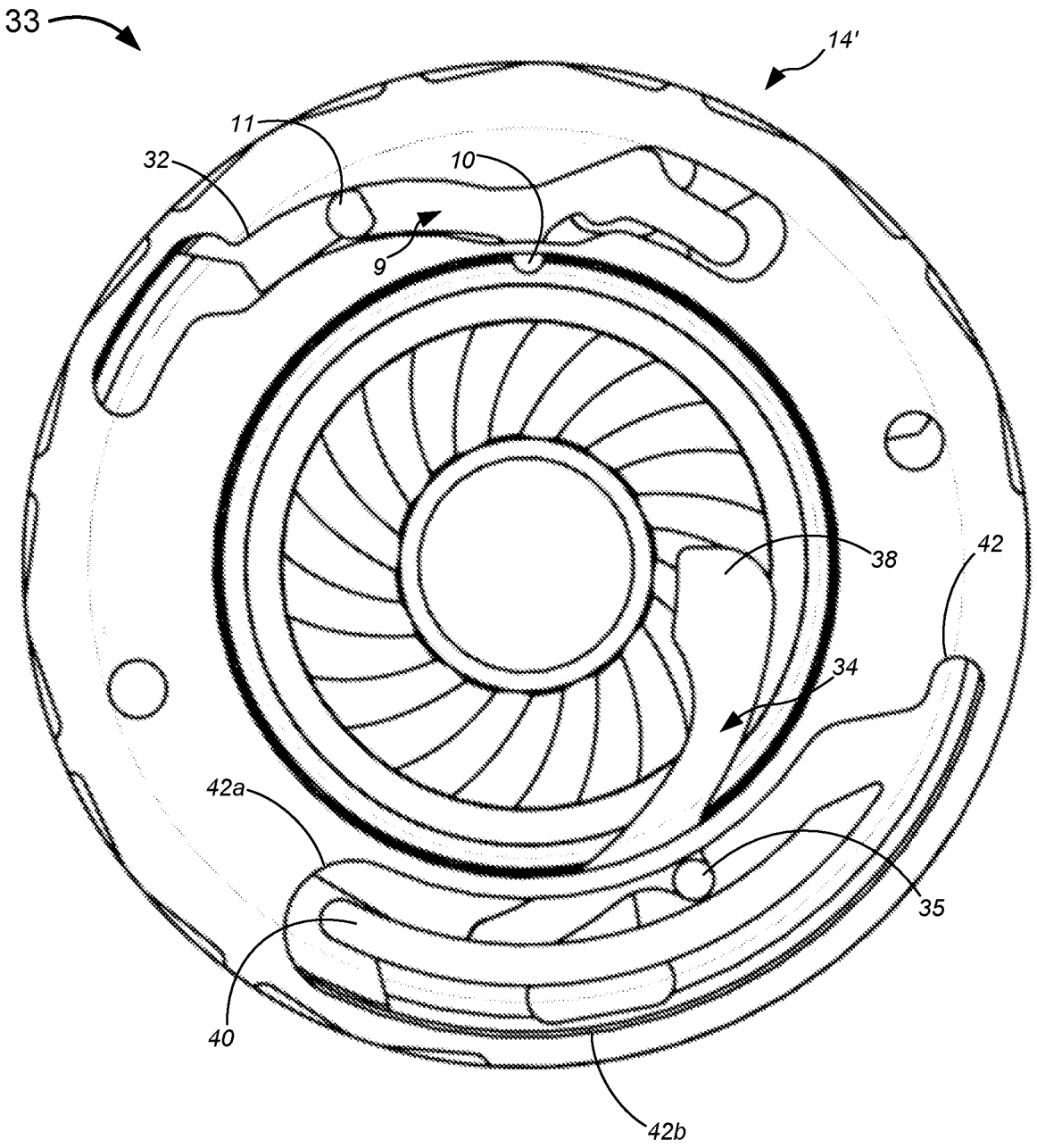
FIG. 15 shows a cross sectional view of the suppressor locking mechanism through the collar slot of another embodiment of the present invention where the locking arm is in the locked state without the muzzle brake or the muzzle attachment being inserted into the suppressor, resulting in the protection arm being engaged to prevent subsequent insertion of the muzzle brake or the muzzle attachment into the suppressor.

FIG. 15 shows a cross sectional view of the suppressor locking mechanism 33 where the locking arm 9 is in the locked state without a muzzle brake or a muzzle attachment (e.g., muzzle attachment 2 of FIGS. 1-12, or the like) being inserted into the suppressor 41, resulting in the protection arm 34 being engaged to prevent subsequent insertion of the muzzle brake or the muzzle attachment into the suppressor. In particular, as shown in FIG. 15, the locking arm 9 has been shifted within the collar 14' such that the collar pin 11 of the locking arm 9 is moved or positioned within the collar slot 32 (with the collar 14' rotated counterclockwise in this exemplary embodiment) until the locking notch 10 is exposed radially inward or is extended toward a central portion of the cylindrical collar 14'. If a muzzle brake or muzzle attachment is present or inserted into the suppressor 41 (which is not the case as shown in the example of FIG. 15), the locking notch 10 would engage with locking positions 3 of muzzle attachment 2, as shown, e.g., in FIGS. 6-8, 11, and/or 12. However, as the locking arm 9 is shifted in the locked state, without the muzzle brake or the muzzle attachment being inserted into the suppressor (as described above and as shown in FIG. 15), the protection arm 34 is shifted within the collar 14' such that the collar pin 35 is moved or positioned within the collar slot 42. Without the muzzle brake or the muzzle attachment being inserted into the suppressor, collar pin 35 is caused to shift along first collar slot 42*a* by the cap ramp 40, which causes the blocking arm 38 to extend radially inward or to extend toward the central portion of the cylindrical collar 14'. Because the blocking arm 38 and the locking notch 10 lie and move within the same plane or within a common plane, the blocking arm 38 of the protection arm 34 serves to prevent full insertion of the muzzle brake or muzzle attachment 2, which, without the presence of the blocking arm 38, may cause damage to the locking notch 10 when the muzzle brake or muzzle attachment 2 is inserted into the suppressor 41 with the locking arm 9 in the unlocked state (as shown in FIG. 15). To disengage the protection arm 34, the collar 14' need only be set to the unlocked state (e.g., rotated in the clockwise direction as shown and described above with respect to FIG. 14).

Figure 16:
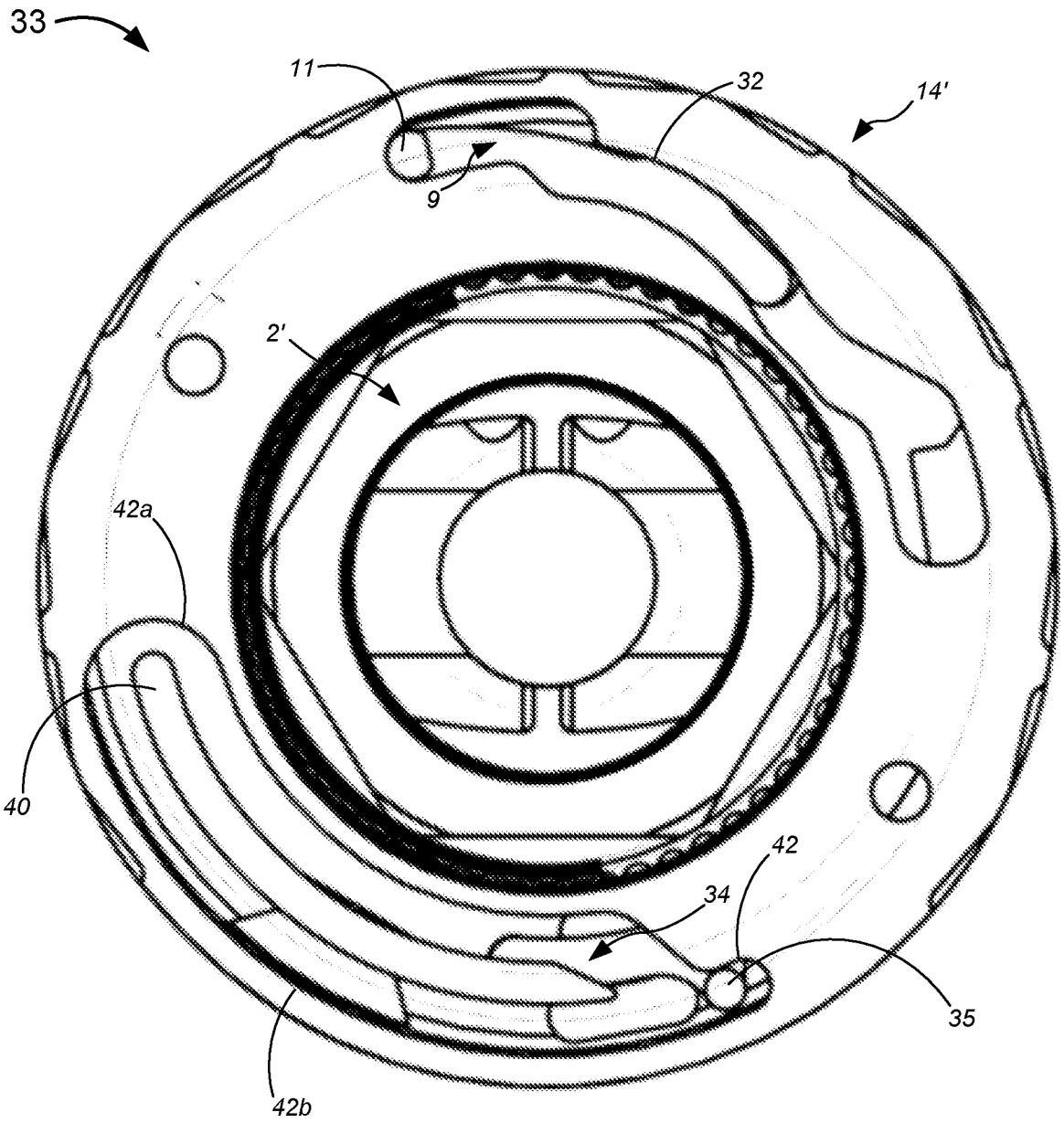
FIG. 16 shows a cross sectional view of the suppressor locking mechanism through the collar slot of another embodiment of the present invention where the locking arm is in the unlocked state with the muzzle brake or the muzzle attachment being inserted into the suppressor.

FIG. 16 shows a cross sectional view of the suppressor locking mechanism 33 where the locking arm 9 is in the unlocked state with the muzzle brake or the muzzle attachment 2' (similar to muzzle attachment 2 of FIGS. 1-12, or the like) being inserted into the suppressor 41. In particular, as shown in FIG. 16, the locking arm 9 has been shifted within the collar 14' such that the collar pin 11 of the locking arm 9 is moved or positioned within the collar slot 32 (with the collar 14' rotated clockwise in this exemplary embodiment) until the collar pin 11 is positioned at an end portion of the collar slot 32. With reference to FIG. 16, as the locking arm 9 is rotated into the unlocked state (i.e., with the collar 14' rotated clockwise in this exemplary embodiment), protection arm 34 is shifted within the collar 14' such that the collar pin 35 of the protection arm 34 is moved or positioned within the collar slot 42, which is divided by cap ramp 40 into first collar slot 42*a* and second collar slot 42*b*, until the collar pin 35 is positioned at an end portion of the collar slot 42.

Figure 17:
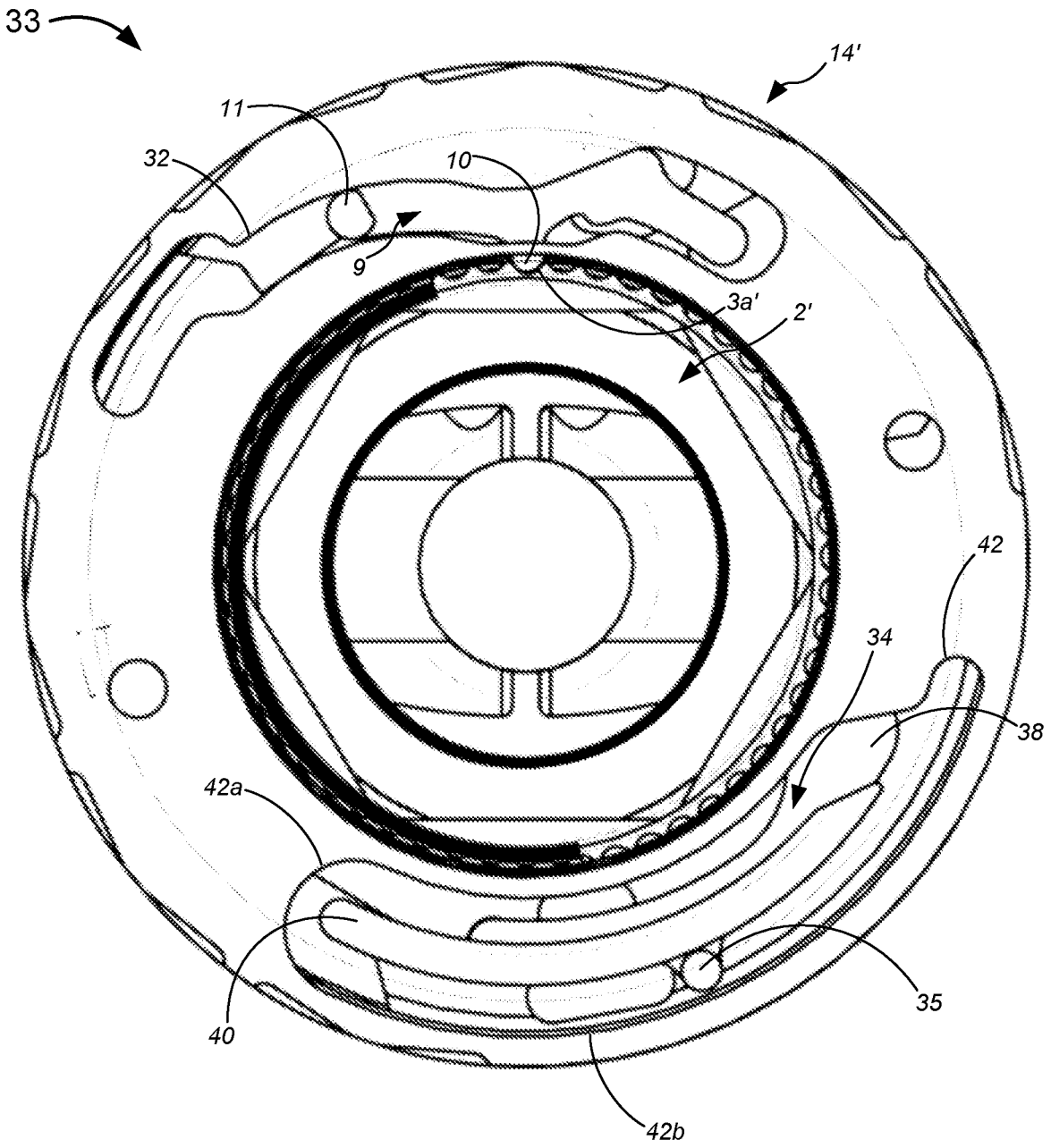
FIG. 17 shows a cross sectional view of the suppressor locking mechanism through the collar slot of another embodiment of the present invention where the locking arm is in the locked state with the muzzle brake or the muzzle attachment being inserted into the suppressor, resulting in the protection arm being disengaged.

FIG. 17 shows a cross sectional view of the suppressor locking mechanism 33 where the locking arm 9 is in the locked state with the muzzle brake or the muzzle attachment 2' (similar to muzzle attachment 2 of FIGS. 1-12, or the like) being inserted into the suppressor 41, resulting in the protection arm 34 being disengaged. In particular, as shown in FIG. 17, the locking arm 9 has been shifted within the collar 14' such that the collar pin 11 of the locking arm 9 is moved or positioned within the collar slot 32 (with the collar 14' rotated counterclockwise in this exemplary embodiment) until the locking notch 10 is exposed radially inward or is extended toward a central portion of the cylindrical collar 14'. With the muzzle brake or muzzle attachment 2' present or inserted into the suppressor 41, the locking notch 10 engages with locking positions 3 of muzzle attachment 2' (similar to the embodiments in FIGS. 6-8, 11, and/or 12), specifically, locking position 3*a*' shown in FIG. 17, in a manner similar to that as shown and described above with respect to FIGS. 4-12. With reference to FIG. 17, as the locking arm 9 is shifted in the locked state, with the muzzle brake or the muzzle attachment 2' being inserted into the suppressor, the protection arm 34 is shifted within the collar 14' such that the collar pin 35 is moved or positioned within the collar slot 42. With the muzzle brake or the muzzle attachment 2' being inserted into the suppressor, the blocking arm 38 is prevented from extending radially inward or extending toward the central portion of the cylindrical collar 14 (as shown in FIG. 16), resulting in collar pin 35 being caused to shift along second collar slot 42*b* by the cap ramp 40 and the muzzle brake or muzzle attachment 2' itself. In this manner, the protection arm 34 is prevented from affecting the locking mechanism 33 when the muzzle brake or the muzzle attachment 2' is inserted into the suppressor 41.

In some embodiments, the protection arm 34 may be biased (in some cases, with the use of at least one of a spring, a weight differential, or the like) to move along the first collar slot 42*a* (which results in the blocking arm 38 extending toward the central portion of the collar), unless the blocking arm 38 is blocked from extending toward the central portion of the collar 14' by the presence of a muzzle brake or muzzle attachment (which results in the protection arm 34 moving along the second collar slot 42*b* and results in the cap ramp 40 preventing the blocking arm 38 from extending toward the central portion of the collar 14' (thus preventing the blocking arm 38 or the protection arm 34 from interfering with the functioning of the locking arm 9 and/or from interfering with the muzzle brake or muzzle attachment 2')).

While various embodiments of the apparatus are described with—or without—certain features for ease of description and to illustrate exemplary aspects of those embodiments, the various components and/or features described herein with respect to a particular embodiment can be substituted, added and/or subtracted from among other described embodiments, unless the context dictates otherwise. Consequently, although several exemplary embodiments are described above, it will be appreciated that the invention is intended to cover all modifications and equivalents within the scope of the following claims.

What is claimed is:

1. A noise suppressor locking mechanism for a firearm, comprising:

a collar;

a locking arm comprising a locking notch;

a protection arm comprising a blocking arm;

wherein, when the collar is rotated to a first state, the locking arm is set to an unlocked state, while the protection arm is set to a disengaged state;

wherein, when the collar is rotated to a second state and when no muzzle attachment has been fully inserted within the collar, the locking arm is set to a locked state with the locking notch extended inward toward a central portion of the collar, while the protection arm is set to an engaged state in which the blocking arm has been extended toward the central portion of the collar, thereby preventing subsequent full insertion of a muzzle attachment into the collar; and wherein, when the collar is rotated to the second state and when a muzzle attachment has been fully inserted within the collar, the locking arm is set to a locked state in which the locking notch engages with a locking position of the muzzle attachment, while the protection arm is set to the disengaged state that prevents the protection arm from affecting the functioning of the locking arm.

2. The noise suppressor locking mechanism of claim 1, wherein the locking notch and the blocking arm lie and move within a common plane.

3. The noise suppressor locking mechanism of claim 1, wherein the locking arm further comprises a first collar pin, wherein the protection arm further comprises a second collar pin, wherein the collar further comprises a first collar slot through which the first collar pin moves when the collar is rotated and a second collar slot through which the second collar pin moves when the collar is rotated.

4. The noise suppressor locking mechanism of claim 3, wherein the collar comprises a collar cap and a cap ramp, wherein the second collar slot is divided by the cap ramp into a third collar slot and a fourth collar slot when the collar cap is removably affixed to the collar, wherein, when the protection arm is being set to the engaged state, the second collar pin of the protection arm is moved along the third collar slot, causing the blocking arm to extend toward the central portion of the collar, and wherein, when the protection arm is being set to the disengaged state, the second collar pin of the protection arm is moved along the fourth collar slot, preventing the blocking arm from extending toward the central portion of the collar.

5. The noise suppressor locking mechanism of claim 4, wherein the protection arm is biased to move along the third collar slot, unless a muzzle attachment that is fully inserted into the collar causes the protection arm to move along the fourth collar slot.

6. The noise suppressor locking mechanism of claim 1, wherein the locking position of the muzzle attachment is one among a plurality of locking positions.

7. A method of attaching a noise suppressor to a muzzle attachment, the method comprising:

rotating a collar of a locking mechanism of a noise suppressor to move a locking arm and a locking notch of the locking mechanism in a circular direction, wherein the locking mechanism further comprises a protection arm comprising a blocking arm;

wherein, when the collar is rotated to a first state, the locking arm is set to an unlocked state, while the protection arm is set to a disengaged state;

wherein, when the collar is rotated to a second state and when no muzzle attachment has been fully inserted within the collar, the locking arm is set to a locked state with the locking notch extended inward toward a central portion of the collar, while the protection arm is set to an engaged state in which the blocking arm has been extended toward the central portion of the collar, thereby preventing subsequent full insertion of a muzzle attachment into the collar; and wherein, when the collar is rotated to the second state and when a muzzle attachment has been fully inserted within the collar, the locking arm is set to a locked state in which the locking notch engages with a locking position of the muzzle attachment, while the protection arm is set to the disengaged state that prevents the protection arm from affecting the functioning of the locking arm.

8. The method of claim 7, wherein the locking notch and the blocking arm lie and move within a common plane.

9. The method of claim 7, wherein the locking arm further comprises a first collar pin, wherein the protection arm further comprises a second collar pin, wherein the collar further comprises a first collar slot through which the first collar pin moves when the collar is rotated and a second collar slot through which the second collar pin moves when the collar is rotated.

10. The method of claim 9, wherein the collar comprises a collar cap and a cap ramp, wherein the second collar slot is divided by the cap ramp into a third collar slot and a fourth collar slot when the collar cap is removably affixed to the collar, wherein, when the protection arm is being set to the engaged state, the second collar pin of the protection arm is moved along the third collar slot, causing the blocking arm to extend toward the central portion of the collar, and wherein, when the protection arm is being set to the disengaged state, the second collar pin of the protection arm is moved along the fourth collar slot, preventing the blocking arm from extending toward the central portion of the collar.

11. The method of claim 10, wherein the protection arm is biased to move along the third collar slot, unless a muzzle attachment that is fully inserted into the collar causes the protection arm to move along the fourth collar slot.

12. The method of claim 7, wherein the locking position of the muzzle attachment is one among a plurality of locking positions.

13. A noise suppressor locking mechanism for a firearm, comprising:

a collar;

a locking mechanism;

a protection arm comprising a blocking arm;

wherein, when the collar is rotated to a first state, the locking mechanism is set to an unlocked state, while the protection arm is set to a disengaged state;

wherein, when the collar is rotated to a second state and when no muzzle attachment has been fully inserted within the collar, the locking mechanism is set to a locked state, while the protection arm is set to an engaged state in which the blocking arm has been extended toward a central portion of the collar, thereby preventing subsequent full insertion of a muzzle attachment into the collar; and wherein, when the collar is rotated to the second state and when a muzzle attachment has been fully inserted within the collar, the locking mechanism is set to a locked state in which the locking mechanism engages with a locking position of the muzzle attachment, while the protection arm is set to the disengaged state that prevents the protection arm from affecting the functioning of the locking mechanism.

14. The noise suppressor locking mechanism of claim 13, wherein the locking mechanism and the blocking arm lie and move within a common plane.

15. The noise suppressor locking mechanism of claim 13, wherein the locking mechanism comprises a first collar pin, wherein the protection arm further comprises a second collar pin, wherein the collar further comprises a first collar slot through which the first collar pin moves when the collar is rotated and a second collar slot through which the second collar pin moves when the collar is rotated.

16. The noise suppressor locking mechanism of claim 15, wherein the collar comprises a collar cap and a cap ramp, wherein the second collar slot is divided by the cap ramp into a third collar slot and a fourth collar slot when the collar cap is removably affixed to the collar, wherein, when the protection arm is being set to the engaged state, the second collar pin of the protection arm is moved along the third collar slot, causing the blocking arm to extend toward the central portion of the collar, and wherein, when the protection arm is being set to the disengaged state, the second collar pin of the protection arm is moved along the fourth collar slot, preventing the blocking arm from extending toward the central portion of the collar.

17. The noise suppressor locking mechanism of claim 16, wherein the protection arm is biased to move along the third collar slot, unless a muzzle attachment that is fully inserted into the collar causes the protection arm to move along the fourth collar slot.

18. The noise suppressor locking mechanism of claim 13, wherein the locking position of the muzzle attachment is one among a plurality of locking positions.

* * * * *